US006722083B2

(12) United States Patent
Herrmann et al.

(10) Patent No.: US 6,722,083 B2
(45) Date of Patent: Apr. 20, 2004

(54) STRUCTURAL UNIT, SPECIFICALLY A DOOR INCLUDING AN INJECTED MOLDED FRAME

(75) Inventors: Bob Herrmann, Spring Lake, MI (US); Howard Daley, Zeeland, MI (US)

(73) Assignee: Gemtron Corporation, Sweetwater, TN (US)

( * ) Notice: Subject to any disclaimer, the term of this patent is extended or adjusted under 35 U.S.C. 154(b) by 0 days.

(21) Appl. No.: 09/994,967

(22) Filed: Nov. 28, 2001

(65) Prior Publication Data

US 2003/0097799 A1 May 29, 2003

(51) Int. Cl.[7] ..... E06B 3/00

(52) U.S. Cl. ..... 49/501; 52/204.63; 52/204.68; 52/204.7; 52/204.72

(58) Field of Search ..... 49/501, 504, 383; 52/204.6, 204.63, 204.68, 204.7, 204.72

(56) References Cited

U.S. PATENT DOCUMENTS

| | | | | |
|---|---|---|---|---|
| 1,686,162 A | | 10/1928 | Lindersmith | |
| 2,359,712 A | | 10/1944 | Howie, Jr. | |
| 2,719,341 A | | 10/1955 | Clerk | |
| 2,956,315 A | | 10/1960 | Lipp et al. | |
| 4,001,972 A | * | 1/1977 | Hurwitz | 49/380 |
| 4,004,389 A | | 1/1977 | DiFazio | |
| 4,199,900 A | * | 4/1980 | Johnston et al. | 49/404 |
| 4,496,201 A | | 1/1985 | Allgeyer | |
| 4,583,796 A | | 4/1986 | Nakajima et al. | |
| 4,948,206 A | | 8/1990 | Fitzpatrick | |
| 4,987,713 A | | 1/1991 | Delafield | |
| 5,040,347 A | | 8/1991 | Valvis | |
| 5,048,233 A | * | 9/1991 | Gidseg et al. | 49/501 |
| 5,058,353 A | | 10/1991 | Gartner | |
| 5,603,190 A | * | 2/1997 | Sanford | 52/202 |
| 5,645,330 A | | 7/1997 | Artwohl et al. | |
| 5,657,592 A | * | 8/1997 | Davlantes | 52/206 |
| 5,713,167 A | | 2/1998 | Durham et al. | |
| 5,894,706 A | * | 4/1999 | Herbst | 52/782.1 |

* cited by examiner

*Primary Examiner*—Jerry Redman
(74) *Attorney, Agent, or Firm*—Diller, Ramik & Wight

(57) ABSTRACT

A door includes a U-shaped frame having opposing side channels. The channels include peripheral, inner and outer walls with the inner wall being of a larger size and configuration than the outer wall. A glass insert slightly smaller than the size of the inner wall is inserted therethrough and is guided to a centered position seated upon the outer wall. An open frame insert is slid into the two side channels, and a plurality of opposing pairs of walls deflect the open frame insert into bearing engagement with the glass insert. A peripheral edge of the open frame insert defines a peripheral channel with a terminal edge of the door frame inner wall for receipt therein of a peripheral securing boss of an elastomeric peripheral seal.

55 Claims, 6 Drawing Sheets

193
191
5
C
14
15
110'
102'
100'
F
194
4
11
23
121
10
23
25
4
23
102
100
5
103

STRUCTURAL UNIT, SPECIFICALLY A DOOR INCLUDING AN INJECTED MOLDED FRAME

BACKGROUND OF THE INVENTION

The invention is directed to a structural unit in the form of a closure or door for opening and closing an opening in a structural housing. The structural housing can be, for example, a wine storage cooler, an under-counter refrigerator or ice-maker, a R-V or marine ice-maker or refrigerator, a refrigerator/freezer combo, an ice-maker/refrigerator combo or the like. Such structural housings include a cabinet having an opening closed by a door and the door can be solid or can include a glass panel, insert or window through which the contents of the cabinet can be viewed. Typically, a wine cabinet or wine captain includes a cabinet having shelves designed to accommodate bottles of wine and the door is hinged for right-hand or left-hand opening and/or closing movement. The door is defined by a peripheral frame and a piece of glass or window which is normally tinted and, when combined with an adjustable "on"/"off" interior light, creates an attractive display of a wine collection.

A conventional wine captain or wine storage cooler is manufactured by U-Line Corporation and includes tempered glass peripherally bounded by a single piece frame of polymeric/copolymeric synthetic plastic material which is extruded in a generally channel-shaped cross-sectional configuration and is appropriately mitred/notched to facilitate the bending of frame at corners of the glass. Appropriate sealing material is placed in the frame channel after which the frame is appropriately folded to peripherally encapsulate the glass with the mitered portions of the channel eventually defining corners of the door. The manufacture and assembly of a door of this type, including the addition thereto of appropriate pivots and a handle, is costly and labor-intensive. Furthermore, the mitered corners are less than aesthetic and can accumulate undesired debris in the area of the opposing mitered edges.

SUMMARY OF THE INVENTION

The present invention represents a novel and unobvious improvement in a door for virtually any housing or enclosure, but particularly for a cabinet, such as a cabinet in part defining a wine storage cooler, a RV or marine ice-maker or the like. In lieu of a conventional extruded frame, mitered and folded or bent about a piece of glass, the door of the present invention is defined by an injection molded door frame which includes a peripheral wall and relatively spaced inwardly projecting inner and outer walls terminating in respective terminal edges defining respective inner and outer openings of the door frame. The inner opening is larger than the outer opening permitting a glass insert having a peripheral edge of a size permitting passage through the inner opening along a path substantially parallel to an axis of the inner opening to be so inserted into the frame, but the outer opening is of a size too small to allow the glass insert to pass therethrough. A second insert in the form of an open frame holding member is slid along a path of travel substantially normal to the inner opening axis into sandwiched relationship between the glass insert and the inwardly projecting door frame inner wall to retain or hold the glass insert in a desired location. Appropriate retaining means are provided for holding the second insert in the sandwiched relationship thereof.

The door frame further includes opposite frame sides and opposite frame ends defining side channels opening in opposing relationship to each other with one of two opposite frame ends also defining an end channel and a second of the two opposite frame ends defining an access area through which the open frame holding or retaining member is slid along the door frame side channels to a seated position relative to the glass insert. The access area is preferably closed by a separate one-piece closure of injection molded plastic material which also preferably defines a gripping portion or handle of the door.

The open frame retaining member includes a peripheral edge which defines a self-receiving peripheral channel with a terminal edge of the door frame inner wall and a peripheral seal is secured within the channel. The peripheral seal effects sealing contact with an associated opening of a cabinet or similar housing.

The door frame also includes means for guiding the glass insert to a centered position relative to the door frame upon movement of the glass insert along the inner opening axis through the inner opening. The centering means are preferably a plurality of guide surfaces spaced about the door frame which converge in a direction from the inner wall toward the outer wall to effect the centering of the glass insert during the movement thereof into the door frame.

Means are also provided for urging the glass insert into intimate seated relationship relative to the outer wall of the door frame which is effected by surfaces of the door frame which slightly deflect or bend a peripheral edge of the open frame retaining member in a direction toward the door frame outer wall creating hold-down forces in the open frame retaining member which are transmitted from an interior peripheral wall thereof to and against the glass insert for urging and holding the glass insert in its seated position.

The door frame also includes at least one nut held captive in each of the two lower corners which are slidable therein through a 90° void at each lower inner wall corner. This construction allows an external pivot member or pivot plate to be threadably secured to at least one nut in either corner of the door frame to effect right-hand or left-hand pivotal opening/closing of the door. The void in each lower corner of the door frame is preferably closed by a snap-in 90° wall portion which merges with the inner wall of the door frame.

BRIEF DESCRIPTION OF THE SEVERAL VIEWS OF THE DRAWINGS

FIG. 4, is an enlarged fragmentary perspective view of one of the corners of the door frame, and illustrates a pair of nuts confined in a housing which are accessible through a void of the inner wall which can be closed by a 90° wall portion.

Figure 1:
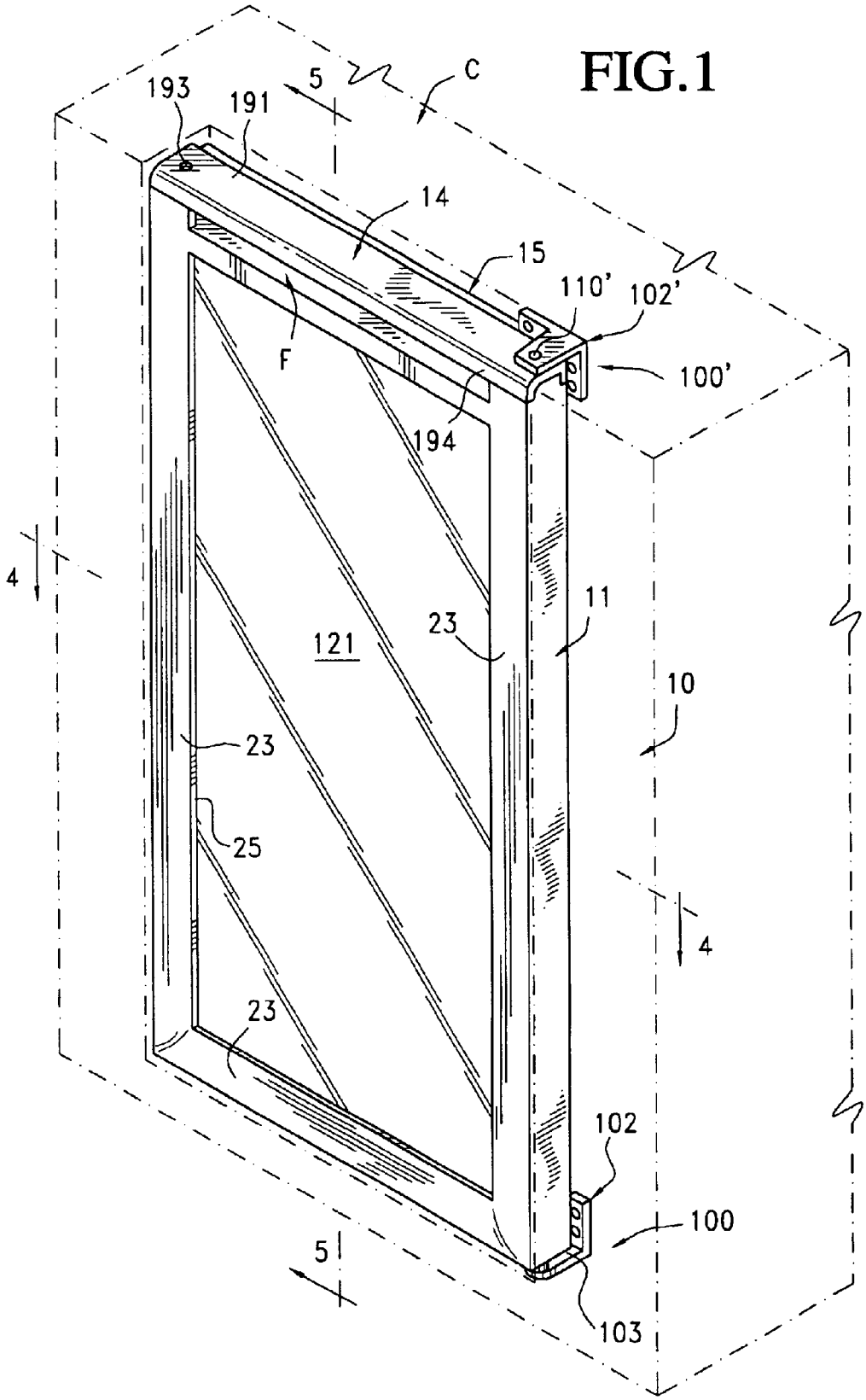
FIG. 1 is a perspective view of a closure or door constructed in accordance with this invention, and illustrates a door frame surrounding a glass insert and corner pivots pivotally mounting the door relative to an associated cabinet for left-to-right pivotal opening movement.

With the above and other objects in view that will hereinafter appear, the nature of the invention will be more clearly understood by reference to the following detailed description, the appended claims and the several views illustrated in the accompanying drawings.

DETAILED DESCRIPTION OF THE INVENTION

A novel structural unit, closure or door constructed in accordance with this invention is generally designated by the reference numeral 10 and includes a door frame 11, a first insert or glass insert 12, a second insert 13, an end closure 14 and a peripheral seal 15 (FIGS. 2, 3, 4 and 5).

The door frame 11 is formed of injection molded synthetic polymeric/copolymeric plastic material and includes a peripheral wall 21, an inner wall 22 and an outer wall 23 with the inner and outer walls 22, 23, respectively, terminating in inner peripheral terminal edges 24, 25, respectively. The walls 21, 22 and 23 define opposite side channels 26, 27 which open in opposing relationship to each other and a bottom end channel 28 (FIGS. 2 and 5) which opens toward an upper end wall 30 spanning and bridging the side channels 26, 27. The upper end wall 30 includes an outer downwardly depending end wall portion 31 merging with the terminal edge 25 at the side channels 26, 27 and an inner upwardly projecting end wall portion 32 spaced from and substantially parallel to three coplanar wall portions 33, 34 and 35 projecting upwardly from the upper end wall 30 and each having a hole 36 therein. Three gaps or slots 43, 44, 45 are defined between each of the upwardly projecting wall portions 33 through 35 and the inner upwardly projecting end wall portion 32 sized to accommodate a depending wall portion 196 (FIG. 3) of the end closure 14 in a manner to be described more fully hereinafter.

Figure 4:
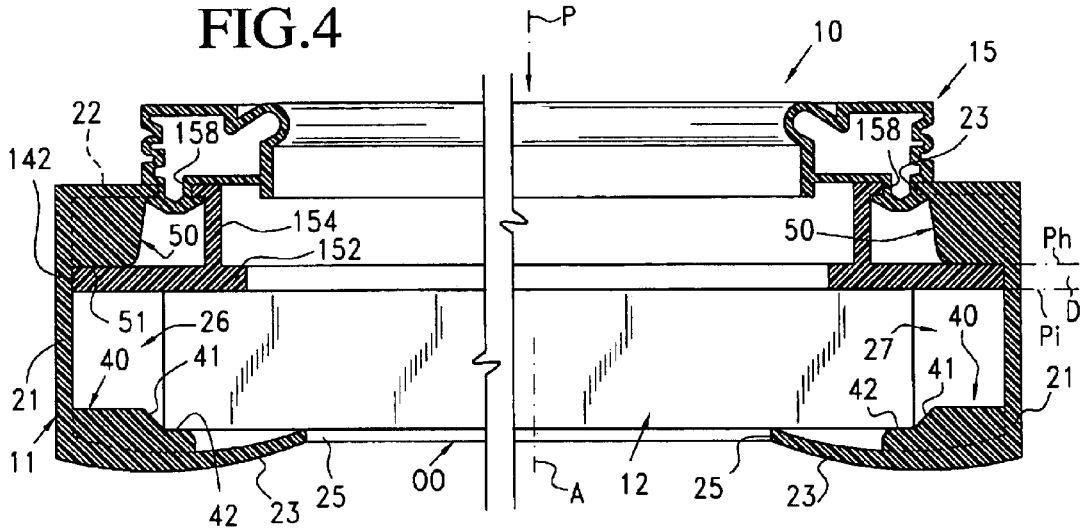
FIG. 4 is an enlarged fragmentary cross-sectional view taken generally along line 4—4 of FIG. 1, and illustrates side channels of the door frame opening toward each other and housing therewithin the glass insert and the open frame hold-down or holding member with a peripheral edge of the latter defining a channel with a terminal edge of an inner wall of the door frame for captively retaining therein the peripheral seal.
Figure 5:
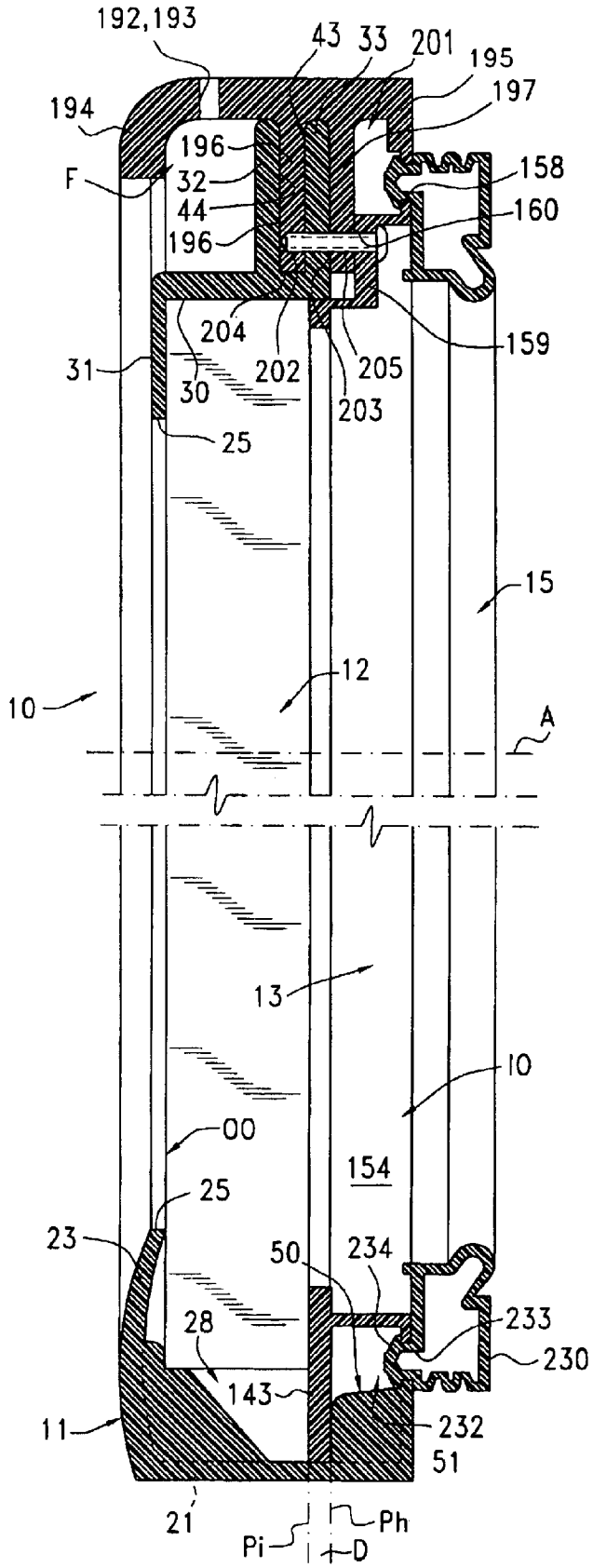
FIG. 5 is an enlarged fragmentary cross-sectional view taken generally along line 5—5 of FIG. 1, and illustrates details of the door including the manner in which fasteners unite the end closure and the open frame hold-down member to the door frame.

The door frame 11 includes an inner opening IO defined by the peripheral terminal edge 24 of the inner wall 22 and an outer opening OO defined by the peripheral inner terminal edge 25 of the outer wall 23. The door frame 11 and the openings IO and OO are each of a generally polygonal/rectangular overall configuration with the inner opening IO being substantially larger in area and configuration than the outer opening OO. An axis A is common to the openings IO and OO (FIGS. 4 and 5). The configurations and sizes of the openings IO and OO relative to each other and to other components of the overall door 10 and the functions thereof will become more apparent hereinafter.

The door frame 10 includes a plurality of identical means 40 spaced from each other and being in bridging relationship and normal to the outer wall 23 and the peripheral wall 21 for guiding the glass insert 12 to a centered position relative to the door frame 11 upon insertion movement of the glass insert 12 into the door frame 11 through the inner opening IO along a path of travel P (FIGS. 2 and 4) parallel to the axis A. Each of the guiding or locating means 40 (FIGS. 2, 4 and 7) is a wall or wall portion having a guiding surface 41 (FIG. 4) which tapers or converges in a direction away from the peripheral wall 21 toward the outer wall 23 and terminates at a supporting surface 42 upon which the glass insert 12 rests (FIG. 4) when inserted into the door frame 11.

The door frame 11 also includes a plurality of means 50 (FIGS. 4, 5 and 7) disposed in spaced relationship to each other and in bridging relationship to the inner wall 22 and the peripheral wall 21 for urging the open frame holding means or insert 13 in downward forceful bearing engagement against the glass insert 12 in the manner best illustrated in FIGS. 4 and 5 of the drawings. A surface 51 of each of the urging means or walls 50 lies in a plane Ph (FIGS. 4 and 5) which in the assembled relationship of the components is spaced a predetermined distance D from a plane Pi parallel to the plane Ph and lying coplanar to abutting surfaces of the glass insert 12 and the open frame holding insert or member 13.

Both the centering means 40, including the centering surfaces 41 thereof, and the urging means 50, including the surfaces 51 thereof, are located in aligned pairs in a common plane along and within the side channels 26 and 27 and the bottom end channel 28, but not along the upper end wall 30 or any of the wall portions 31, 32, 33, etc. thereof.

Identical lower corners 60, 61 (FIGS. 2, 3 and 7) of the door frame 11 each include an identical slot or void 62 (FIG. 7) between inclined end terminal edges 63, 64 of the inner wall 22. A ledge 65 extends between the end terminal edges 63, 64 at outermost ends (unnumbered) thereof, while at inner most ends of each of the inner wall end edges 63, 64, a gap 66 is defined between the surfaces 51 of the urging walls 50 which is of a size to receive respective flanges 73, 74 of a 90° wall portion 75 having a projecting ledge 76. The 90° wall portion 75 can be readily slid into and removed from each of the corners 60, 61 and when inserted therein closes the void or gap 62 (FIG. 3) to hide from view a fastener housing 80 (FIG. 7) in each corner 60, 61.

Figure 7:
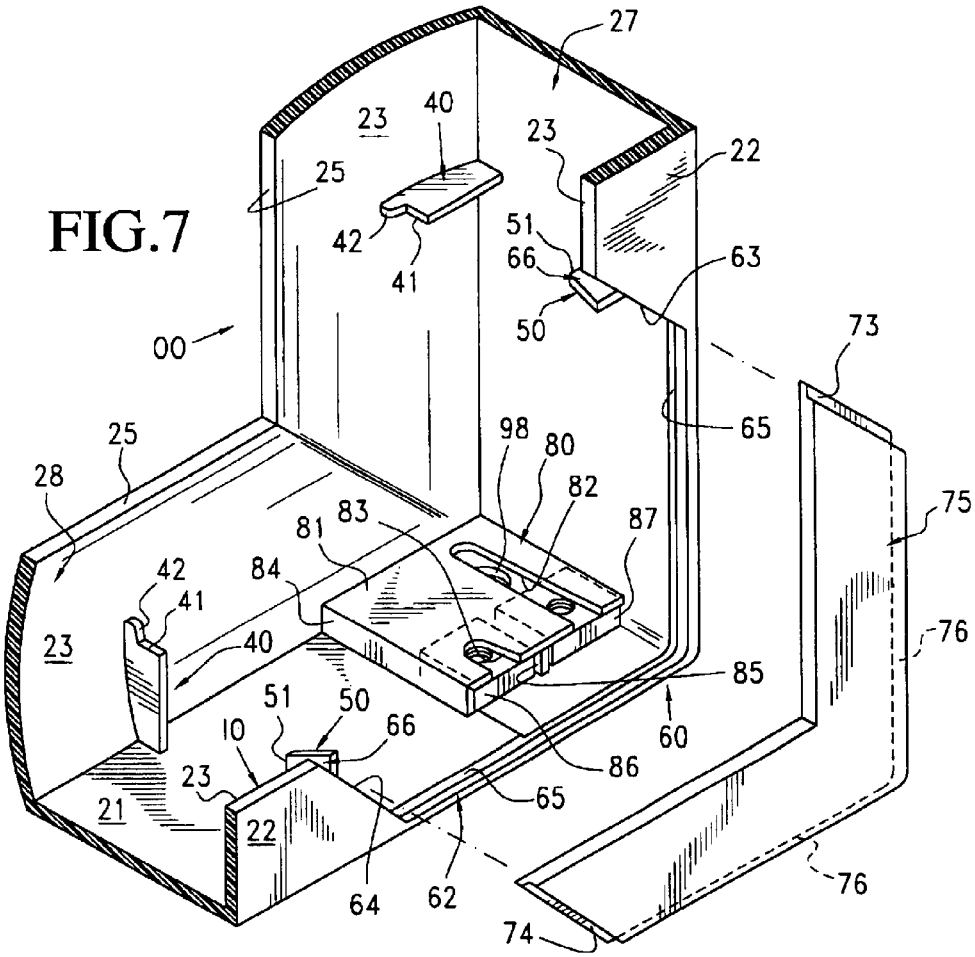
FIG. 7, which appears on the sheet of drawing containing
Figure 6:
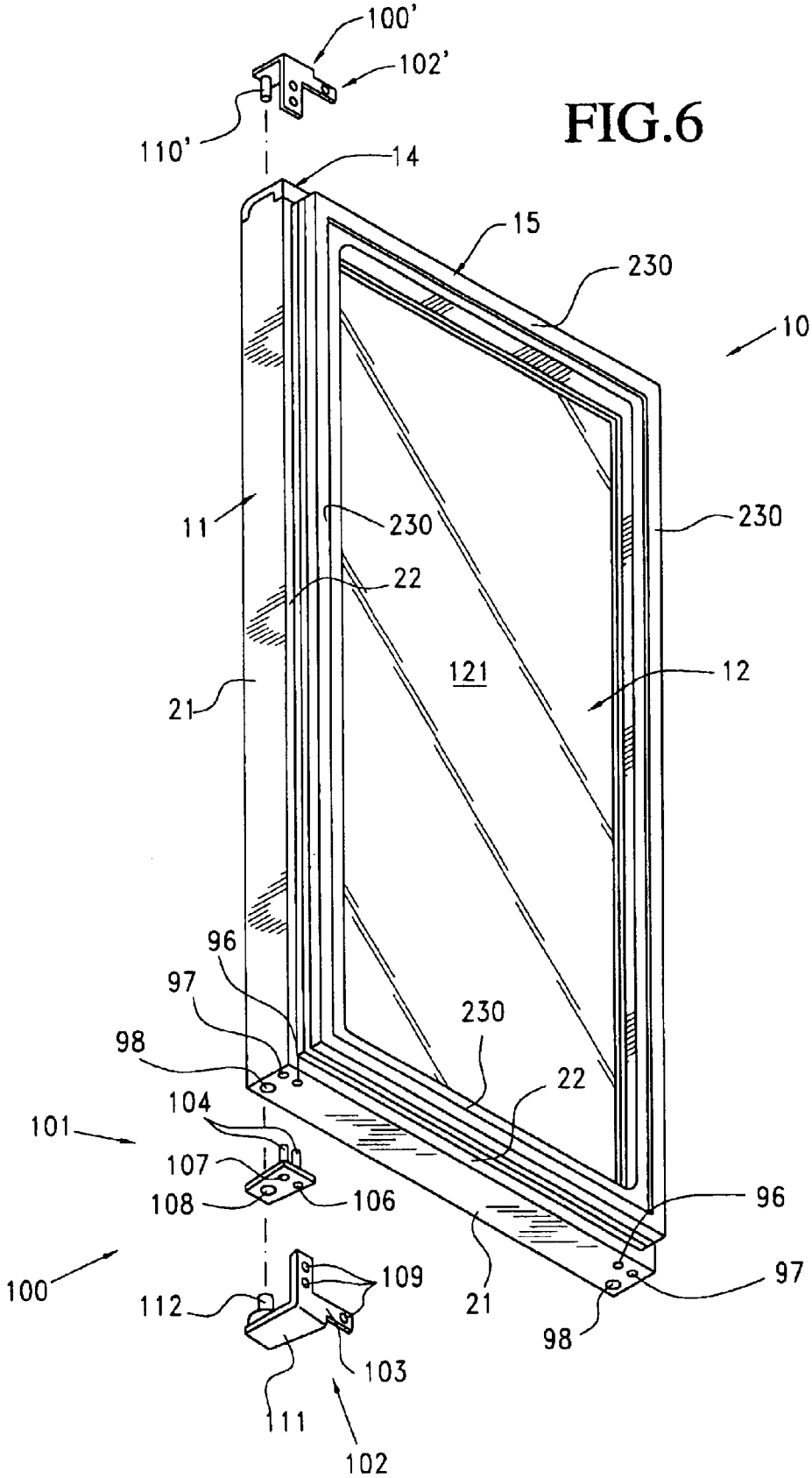
FIG. 6 is an exploded perspective view of the door looking at an interior side thereof, and illustrates the manner in which pivots are associated with upper and lower corners of the door frame and a polygonal peripheral seal.

Each fastener housing 80 is integrally formed as part of the injection molded one-piece door frame 11 and includes a top wall 81 having an elongated slot 82 and a short slot 83. A side wall 84 depends down from and is parallel to a similar depending central wall 85. Threaded fasteners 86, 87, such as a nut, are slid into the fastener housing 80 from the exterior of the door frame 11 when the wall portion 75 is removed (FIG. 7). Threaded openings (unnumbered) of the fasteners or nuts 86, 87 are aligned with openings 96, 97 (FIG. 6), respectively, in the peripheral wall 21 while another opening 98 (FIG. 6), somewhat larger than the openings 96, 97, opens into and is aligned with the elongated slot 82 of the top wall 81 of the housing 80. The fastener housing 80, the nuts 86, 87, and the openings or holes just described are utilized for receiving therein/securing thereto a pivot plate 101 of lower pivot means 100 (FIG. 6) which additionally includes a second pivot plate 102.

The pivot plate 101 (FIG. 6) has three openings 106, 107 and 108 which are aligned with the respective openings 96 through 98. Identical threaded screws 104 are passed through the holes 106, 96 and 107, 97 and are threaded securely into the respective nuts 86, 87 to rigidly connect the first pivot plate 101 to the door frame 11 at the corner 60.

The second pivot plate 102 of the pivot means 100 includes a 90° leg 103 having openings 109 through which fasteners pass for securing the 90° leg 103 to a structure, such as a cabinet C (FIG. 1), while another leg 111 normal to the leg 103 carries a pivot pin 112 which is received in the aligned openings 108, 98. An identical pivot plate 102' (FIG. 6) of pivot means 100' includes a pivot pin 112' aligned with the pivot pin 112 (FIG. 1) which is received in a hole 192 of the end closure 14 for pivotally mounting the door 10 to the cabinet C in the manner best illustrated in FIG. 1 of the drawings for either right-hand or left-hand direction opening (and/or closing) depending upon the corner (60, 61) to which the pivot means 100, 100' are connected.

The glass insert 12 is of a conventional construction and includes a rigid metallic peripheral frame 120 (FIG. 2), two pieces of relative spaced tempered and tinted glass collectively identified by the reference numeral 121 and an exterior peripheral seal 122 defining a peripheral, polygonal or rectangular outer surface 123. The peripheral surface 123 essentially defines a polygonal peripheral edge of the glass insert 12 and is of a overall size and configuration slightly less than the size of the inner opening IO of the door frame 11. Because of the latter relative dimensioning of the peripheral edge 123 of the glass insert 12, as compared to the slightly larger size of the inner opening IO of the door frame 11 as defined by the terminal edge 24 of the inner wall 22, the glass insert 12 can be inserted through the inner opening IO in the direction of the assembly arrow or path P of FIG. 2 which is substantially parallel to the axis A. During this insertion, the peripheral edge 123 of the glass insert 12 passes through and beyond the inner wall terminal edge 24 and, if not perfectly centered, will contact one or more of the centering surfaces 41 which, due to the convergence thereof toward the outer wall 23, guide the glass insert 12 to its seated position against the supporting surfaces 42 of all of the guiding walls 40.

Figure 2:
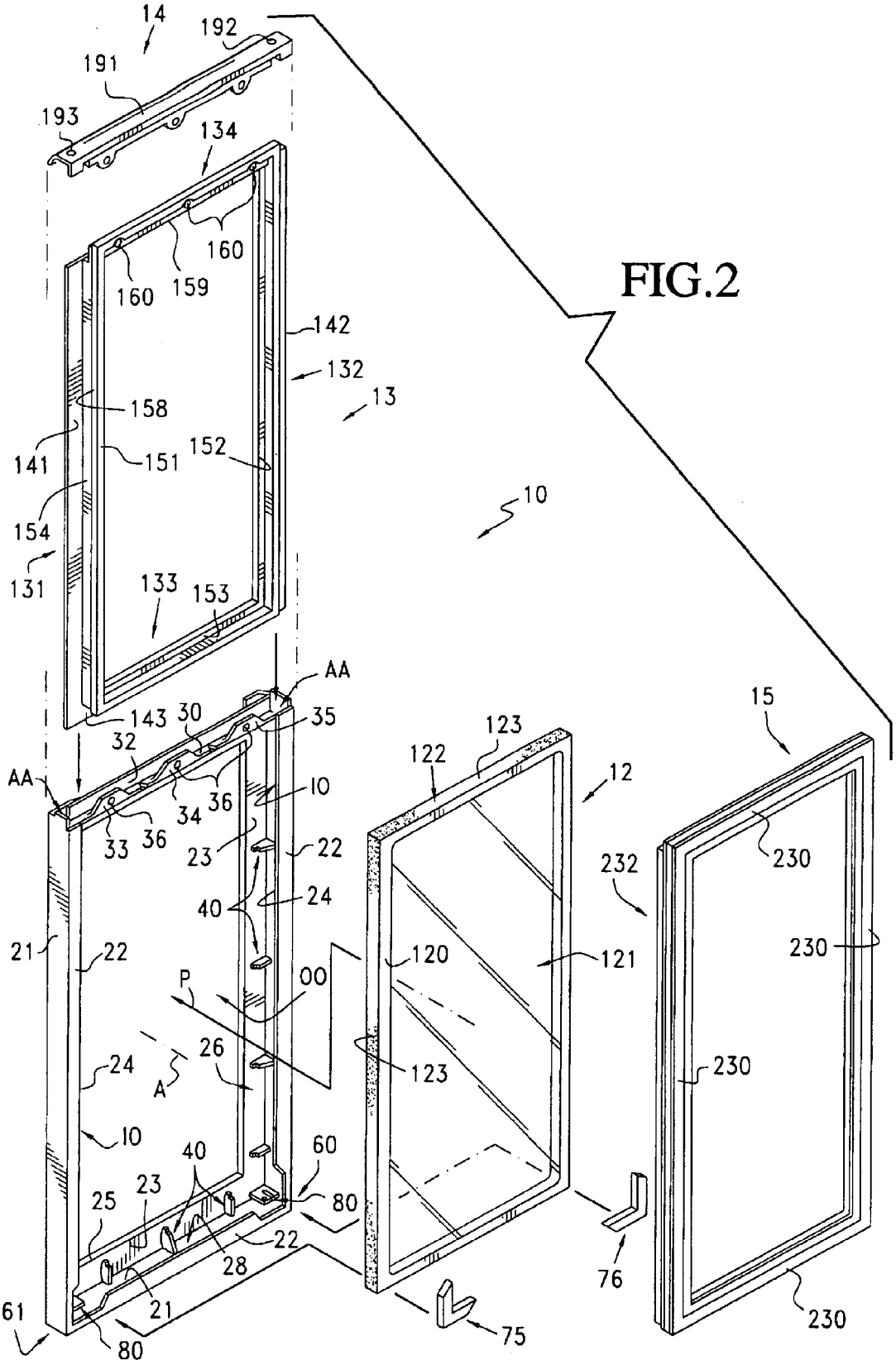
FIG. 2 is an exploded perspective view of the door of FIG. 1, and illustrates various components thereof including a one-piece door frame, a glass insert, an open frame retaining or holding member for holding the glass insert seated relative to the door frame, an end closure which includes a gripping handle portion, and a peripheral seal.

The second insert 13 is constructed for sliding assembly and disassembly relative to the door frame 11, and when located therein serves to hold or retain the glass insert 12 properly located within the door frame 11. The second insert or open frame holding means or member 13 is of a one-piece injection molded construction and includes opposite frame sides 131, 132 in substantially parallel relationship to each other and opposite substantially parallel frame ends 133, 134. The frame sides 131, 132 and the frame end 133 include respective outwardly projecting peripheral walls 141, 142 and 143 which are in coplanar relationship to respective inwardly projecting walls 151, 152 and 153. A peripheral wall 154 is normal to the walls 141, 151; 142, 152; and 143, 153 and terminates in an outwardly directed peripheral terminal edge 158 (FIG. 4). An outer projecting wall 159 of the frame end 134 includes three openings 160 spaced from each other a distance corresponding to the spacing between the openings or holes 36 of the projecting wall portions 33 through 35 of the door frame 11 (FIG. 2). The thickness of the side peripheral walls 141, 142 and the end peripheral wall 143 is slightly greater than the distance D (FIG. 4) for a purpose to be described more fully hereinafter.

After the glass insert 12 has been inserted into the door frame 11 in the manner heretofore described, the open frame holding insert or member 13 is slid into the door frame 11 in a manner evident from FIG. 2 of the drawings along an assembly path of travel Ap. Since the upper frame end wall 30 of the door frame 11 is devoid of the inner wall 22 and a terminal edge 149 (FIG. 3) is spaced from the inner wall 22 the thickness of the walls 141, 142 and 143 of the open frame hold-down member 13, an access area or access means AA is provided at each upper corner (unnumbered) between the terminal edge 149 of the upper frame end wall 30 and overlying portions of the inner wall 22 of the door frame 11 through which can slide the side walls 141, 142 of the open frame holding insert 13 as it descends along the path of assembly Ap. During the latter sliding assembly, the side walls 141, 142 of the open frame holding insert 13 slide along the previously assembled glass insert 12 and eventually encounter the first pair of holding members 50 across from each other in the side channels 26, 27 (FIG. 4). Since the distance D (FIG. 4) is slightly less than the thickness of the side walls 141, 142, the latter walls will deflect to a slightly downwardly concavely opening configuration, as viewed in FIG. 4, and will eventually pass through the first pair and succeeding pairs of opposite holding members 50, including those in the bottom end channel 28. The latter slight deflection of the side walls 141, 142 and the end wall 143 of the open frame hold-down member 13 urges the window insert 12 into intimate bearing engagement with the plurality of supporting surfaces 42 of the walls 40 assuring that the glass insert 12 is held firmly seated within the door frame 11.

Figure 3:
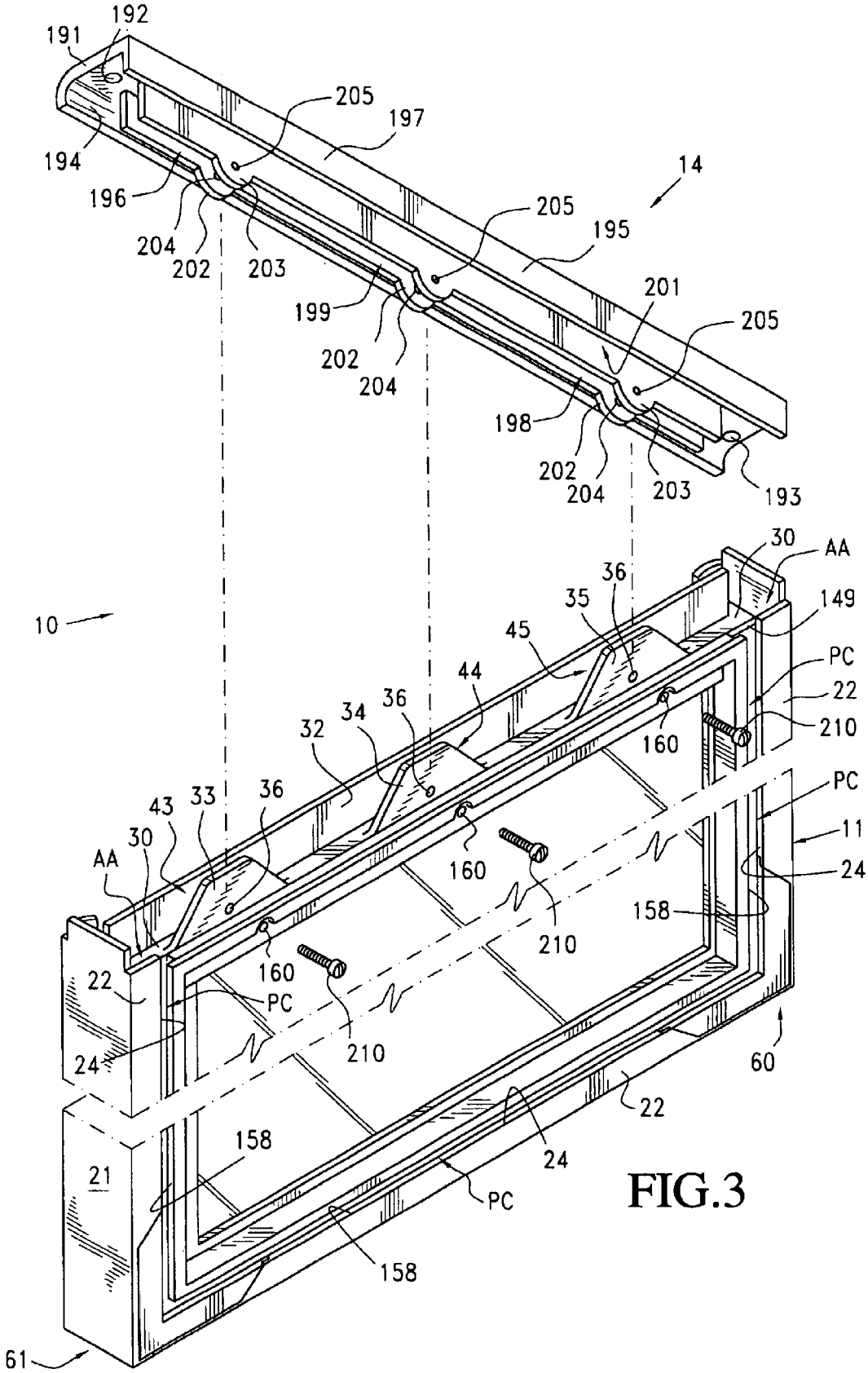
FIG. 3 is an enlarged fragmentary perspective view of the interior side of the door, and illustrates the manner in which fasteners secure the end closure to the door frame at an upper end of the door.

The end closure 14 (FIGS. 1, 2, 3 and 5) functions to close the access openings AA and retain the inserts 12, 13 within the door frame 11 in the assembled relationship heretofore described. As is best illustrated in FIG. 3, the end closure 14 includes an upper end wall 191 provided with pivot pin receiving holes or openings 192, 193 at opposite ends thereof, a depending curved front wall 194 and a rear wall 195. A pair of medial walls 196, 197 are in spaced relationship to each other and define a gap 198 therebetween. There is also a gap 199 between the walls 194, 196 and a gap 201 between the walls 195, 197. Each of the walls 196, 197 include identical respective projections 202, 203 having respective openings 204, 205 with the openings 204 and 205 being spaced from each other a distance corresponding to the spacing between the openings 33 through 35 and 160.

In the partially assembled condition of the door 10 of FIG. 3, all components have been assembled relative to the door frame 11 except for the end closure 14. The end closure 14 is essentially moved downwardly from the position shown in FIG. 3 at which time the three projecting wall portions 33 through 35 are sandwiched between the walls 196, 197 in the gap 198 with the openings 36 being aligned with the openings 204, 205 of the end closure 14 and with the openings 160 of the open frame holding insert 13. Retaining means or holding means in the form of threaded fasteners, such as screws 210 (FIG. 3), are then threaded one each into all of the aligned openings 160, 36, 202 and 203 to securely fix the end closure 14 to the door frame 11 in the manner clearly apparent from FIG. 5 in which a finger grip area F is defined between the curved wall 194 of the end closure 14 and the inner upwardly projecting end wall 32 of the door frame 11. The finger portion F allows the user to grip the curved wall portion 194 to open and close the door 10 while the end closure 13 also closes the entire top of the door frame 11 including the top corner access areas AA.

The peripheral seal 15 is also of a generally polygonal or rectangular configuration and includes a peripheral sealing surface 230 (FIG. 5) and a peripheral attaching portion 232 defined by a narrow peripheral attaching neck 233 and a relatively larger peripheral attaching head 234. As is most evident from FIGS. 3, 4 and 5, the peripheral edge 24 of the inner wall 22 and the terminal peripheral edge 158 of the open frame hold down member or insert 13 define a peripheral channel PC (FIG. 3) having a width corresponding substantially to the peripheral neck 233 of the peripheral seal 15. However, since the peripheral head 234 is slightly larger than the size of the peripheral channel PC, the head 234 will deform as it is forced through the channel PC about the entire periphery of the latter and subsequently rebounds to the seated position shown in FIGS. 4 and 5 to retain the peripheral seal 15 assembled to the door. The sealing surface 230 contacts an opposing sealing surface (not shown) of the cabinet C when closed (FIG. 1).

Although a preferred embodiment of the invention has been specifically illustrated and described herein, it is to be understood that minor variations may be made in the apparatus without departing from the spirit and scope of the invention, as defined by the appended claims.

What is claimed is:

1. A structural unit comprising a frame formed of molded synthetic polymeric/copolymeric plastic material, said frame being defined by a peripheral wall and relatively spaced inwardly projecting inner and outer walls terminating in respective terminal edges, said inner and outer wall terminal edges defining respective inner and outer openings, said inner opening being larger than said outer opening, an insert, said insert having a peripheral edge of a size to pass through said inner opening along a path substantially parallel to an axis of said inner opening but of a size too large to pass through said outer opening, said insert being located in a plane between said inner and outer walls, means for holding said insert in said frame, an access area through which said holding means is slid along a path of travel substantially normal to said inner opening axis into sandwiched relationship between said insert and said inwardly projecting inner wall, and means for retaining said holding means in the sandwich relationship thereof.

2. The structural unit as defined in claim 1 wherein said frame includes opposite frame sides each defining a side channel, and said side channels open in opposing relationship to each other.

3. The structural unit as defined in claim 2 including means for guiding said insert to a centered position relative to said frame upon the movement of said insert along said inner opening axis through said inner opening and toward said outer opening.

4. The structural unit as defined in claim 2 including means for locating said holding means between said inner wall and said insert.

5. The structural unit as defined in claim 2 including means for urging said holding means against said insert.

6. The structural unit as defined in claim 2 including means for guiding said insert to a centered position relative to said frame upon the movement of said insert along said inner opening axis through said inner opening and toward said outer opening, and said guiding means are guiding surfaces located In said frame side channels.

7. The structural unit as defined in claim 2 including means for locating said holding means between said inner wall and said insert, and said holding means are surfaces located in said frame side channels.

8. The structural unit as defined in claim 2 including means for urging said holding means against said insert, and said urging means are surfaces located in said frame side channels.

9. The structural unit as defined in claim 2 including means for guiding said insert to a centered position relative to said frame upon the movement of said insert along said inner opening axis through said inner opening and toward said outer opening, and said guiding means are guiding surfaces located in and spaced along said frame side channels.

10. The structural unit as defined in claim 2 including means for locating said holding means between said inner wall and said insert, and said holding means are surfaces located in and spaced along said frame side channels.

11. The structural unit as defined in claim 2 including means for urging said holding means against said insert, and said urging means are surfaces located in and spaced along said frame side channels.

12. The structural unit as defined in claim 1 wherein said frame includes opposite frame sides and opposite frame ends collectively defining said frame, said opposite frame sides each define a side channel, said side channels open in opposing relationship to each other, and one of said frame ends defines said access area.

13. The structural unit as defined in claim 1 wherein said frame includes opposite frame sides and opposite frame ends collectively defining said frame, said opposite frame sides and one of said opposite frame ends each define a channel, said opposite frame side channels open in opposing relationship to each other, said one frame end channel opens toward another of said frame ends, and said another frame end defines said access area.

14. The structural unit as defined in claim 13 wherein said holding means is a second insert in the form of an open frame having a peripheral configuration corresponding to and a size greater than the size of said inner opening.

15. The structural unit as defined in claim 13 wherein said holding means is a second insert in the form of an open frame having a peripheral configuration corresponding to and a size greater than the size of said inner opening, said open frame having side edges, and each open frame side edge being housed in an associated frame side channel.

16. The structural unit as defined in claim 15 including means in said frame side channels for guiding said insert to a centered position relative to said frame upon the movement of said insert along said axis through said inner opening and toward said outer opening.

17. The structural unit as defined in claim 15 including means in said frame side channels for locating said open frame side edges between said inner wall and said first-mentioned insert.

18. The structural unit as defined in claim 17 wherein said open frame side edges locating means are a plurality of surfaces located in a plane spaced from said open frame side edges a distance corresponding substantially to the thickness of said open frame side edge whereby the open frame side edges are located substantially confined between said last-mentioned plurality of surface and an opposing surface of said insert.

19. The structural unit as defined in claim 15 including means in said frame side channels for urging said open frame side edges against said insert.

20. The structural unit as defined in claim 15 including means in said frame side channels for urging said open frame side edges against said insert, and said open frame side edges urging means are a plurality of surfaces located between said inner and outer walls.

21. The structural unit as defined in claim 15 including means in said frame side channels for guiding said insert to a centered position relative to aid frame upon the movement of said insert along said axis through said inner opening and toward said outer opening, and said insert guiding means are a plurality of surfaces located between said inner and outer walls in converging relationship from said inner wall toward said outer wall.

22. The structural unit as defined in claim 15 including means in said frame side channels for guiding said insert to a centered position relative to said frame upon the movement of said insert along said axis through said inner opening and toward said outer opening, and said insert guiding means are a plurality of surfaces located in spaced relationship to each other and between said inner and outer walls in converging relationship from said inner wall toward said outer wall.

23. The structural unit as defined in claim 1 including means for closing said access area.

24. The structural unit as defined in claim 1 including means for guiding said insert to a centered position relative to said frame upon the movement of said insert along said inner opening axis through said Inner opening and toward said outer opening.

25. The structural unit as defined in claim 1 wherein said holding means is a second insert in the form of an open frame having a peripheral configuration corresponding to and a size greater than the size of said inner opening.

26. The structural unit as defined in claim 1 wherein said frame includes opposite frame sides each defining a channel, said channels open in opposing relationship to each other, said holding means is a second insert in the form of an open frame having a peripheral configuration corresponding to and a size greater than the size of said inner opening, said open frame having opposite sides, and said open frame opposite sides being received each in one of said first-mentioned frame side channels.

27. The structural unit as defined in claim 1 including a peripheral seal, and said peripheral seal includes a peripheral edge located between said frame inner wall and said holding means.

28. The structural unit as defined in claim 27 wherein said holding means includes a peripheral edge, said holding means peripheral edge and said frame inner wall terminal edge define a channel, and said peripheral seal includes a portion confined in said last-mentioned channel.

29. The structural unit as defined in claim 27 wherein said holding means includes a peripheral edge, said holding means peripheral edge and said frame inner wall terminal edge define a channel, and said peripheral seal includes a portion confined in said last-mentioned peripheral channel.

30. The structural unit as defined in claim 1 wherein said holding means is a second insert in the form of an open frame having a peripheral configuration corresponding to and a size greater than the size of said inner opening, and said first-mentioned frame includes means for locating said open frame between said inner wall and said first-mentioned insert.

31. The structural unit as defined in claim 1 wherein said holding means is a second insert in the form of an open frame having a peripheral configuration corresponding to and a size greater than the size of said inner opening, and said first-mentioned frame includes means for urging said open frame against said first-mentioned insert adjacent said insert peripheral edge.

32. The structural unit as defined in claim 1 including means for closing said access area.

33. The structural unit as defined in claim 1 including means for closing said access area, said structural unit is a closure, and said access area closing means includes gripping means for manipulating said closure.

34. The structural unit as defined in claim 1 including means for closing said access area, said structural unit is a door, and said access area closing means includes handle means for manipulating said door.

35. The structural unit as defined in claim 1 wherein said retaining means are fastening means for securing said holding means to said frame.

36. The structural unit as defined in claim 35 including means for closing said access area, and said retaining means additionally retain said closing means secured to said frame.

37. The structural unit as defined in claim 35 including means for closing said access area, and said retaining means additionally retains said closing means secured to said frame.

38. The structural unit as defined in claim 1 including means for locating said holding means between said inner wall and said insert.

39. The structural unit as defined in claim 1 including means for urging said holding means against said insert.

40. A structural unit comprising a frame formed of molded synthetic polymeric/copolymeric plastic material, said frame being defined by a peripheral wall and relatively spaced inwardly projecting inner and outer walls terminating in respective terminal edges, said inner and, outer wall terminal edges defining respective inner and outer openings, said inner opening being larger than said outer opening, an insert, said insert having a peripheral edge of a size to pass through said inner opening along a path substantially parallel to an axis of said inner opening but of a size too large to pass through said outer opening, said insert being located in a plane between said inner and outer walls, means for holding said insert in said frame, an access area through which said holding means is slid along a path of travel substantially normal to said inner opening axis into sandwiched relationship between said insert and said inwardly projecting inner wall, and means for closing said access area.

41. The structural unit as defined in claim 40 wherein said structural unit is a closure, and said access area closing means includes gripping means for manipulating said closure.

42. The structural unit as defined in claim 41 wherein said frame includes opposite frame sides and opposite frame ends collectively defining said frame, said opposite frame sides each define a side channel, said side channels open in opposing relationship to each other, and one of said frame ends defines said access area.

43. The structural unit as defined in claim 41 wherein said frame includes opposite frame sides and opposite frame ends collectively defining said frame, said opposite frame sides and one of said opposite frame ends each define a channel, said opposite frame side channels open in opposing relationship to each other, said one frame end channel opens toward another of said frame ends, and said another frame end defines said access area.

44. The structural unit as defined in claim 40 wherein said structural unit is a door, and said access area closing means includes handle means for manipulating said door.

45. The structural unit as defined in claim 44 wherein said frame includes opposite frame sides and opposite frame ends collectively defining said frame, said opposite frame sides each define a side channel, said side channels open in opposing relationship to each other, and one of said frame ends defines said access area.

46. The structural unit as defined in claim 44 wherein said frame includes opposite frame sides and opposite frame ends collectively defining said frame, said opposite frame sides and one of said opposite frame ends each define a channel, said opposite frame side channels open in opposing relationship to each other, said one frame end channel opens toward another of said frame ends, and said another frame end defines said access area.

47. The structural unit as defined in claim 40 wherein said access area closing means includes means for pivotally mounting said frame to an associated structure.

48. The structural unit as defined in claim 47 wherein said frame includes opposite frame sides and opposite frame ends collectively defining said frame, said opposite frame sides each define a side channel, said side channels open in opposing relationship to each other, and one of said frame ends defines said access area.

49. The structural unit as defined in claim 47 wherein said frame includes opposite frame sides and opposite frame ends collectively defining said frame, said opposite frame sides and one of said opposite frame ends each define a channel, said opposite frame side channels open in opposing relationship to each other, said one frame end channel opens toward another of said frame ends, and said another frame end defines said access area.

50. A structural unit comprising a frame formed of molded synthetic polymeric/copolymeric plastic material, said frame being defined by a peripheral wall and relatively spaced inwardly projecting inner and outer walls terminating in respective terminal edges, said inner and outer wall terminal edges defining respective inner and outer openings, said inner opening being larger than said outer opening, an insert, said insert having a peripheral edge of a size to pass through said inner opening along a path substantially parallel to an axis of said inner opening but of a size too large to pass through said outer opening, said insert being located in a plane between said inner and outer walls, means for holding said insert in said frame, an access area through which said holding means is slid along a path of travel substantially normal to said inner opening axis into sandwiched relationship between said insert and said inwardly projecting inner wall, a peripheral seal, and means for retaining said peripheral seal in peripheral bounding relationship to said frame.

51. The structural unit as defined in claim 50 wherein said peripheral seal retaining means is a channel defined between said frame inner wall and a peripheral surface of said holding means.

52. The structural unit as defined in claim 51 wherein said holding means is a second insert in the form of an open frame having a peripheral configuration corresponding to and a size greater than the size of said inner opening.

53. The structural unit as defined in claim 52 wherein said open frame includes first and second peripheral edges, said first peripheral edge being said greater size, said second peripheral edge having a peripheral configuration corresponding to and of a size substantially less than the side of said inner opening and defining therewith said channel, and a peripheral portion of said peripheral seal is confined in said channel.

54. The structural unit as defined in claim 51 wherein said frame includes opposite frame sides each defining a channel, said channels open in opposing relationship to each other, said holding means is a second insert in the form of an open frame having a peripheral configuration corresponding to and a size greater than the size of said inner opening, said open frame having opposite sides, and said open frame opposite sides being received each in one of said first-mentioned frame side channels.

55. The structural unit as defined in claim 53 wherein said open frame includes first and second peripheral edges, said first peripheral edge being said greater size, said second peripheral edge having a peripheral configuration corresponding to and of a size substantially less than the side of said inner opening and defining therewith said channel, and a peripheral portion of said peripheral seal is confined in said channel.

* * * * *